US005453776A

United States Patent [19]

Günther

[11] Patent Number: 5,453,776

[45] Date of Patent: Sep. 26, 1995

[54] HEATING ELEMENT ENERGIZATION METHOD FOR A THERMAL PRINTER

[75] Inventor: Stephan Günther, Berlin, Germany

[73] Assignee: Francotyp-Postalia GmbH, Berlin, Germany

[21] Appl. No.: 935,842

[22] Filed: Aug. 25, 1992

[30] Foreign Application Priority Data

Oct. 7, 1991 [DE] Germany ..... 41 33 207.5

[51] Int. Cl.[6] ..... B61J 2/38

[52] U.S. Cl. ..... 347/185

[58] Field of Search ..... 346/76 PH; 400/120; 347/185

[56] References Cited

U.S. PATENT DOCUMENTS 4,859,093 8/1989 Plotnick ..... 346/76 PH

FOREIGN PATENT DOCUMENTS 0329369 8/1989 European Pat. Off. .
3833746 4/1990 Germany .
60-67178A 4/1985 Japan .
61-239966A 10/1986 Japan .

*Primary Examiner*—Huan H. Tran

[57] ABSTRACT

A method for controlling the energization of a thermal printing heating element by a succession of current impulses (I) separated according to a printing raster is described. The current impulses (I) upon exceeding a pre-given energy content effect a printing event and in the case of falling below this energy content effect a preheating. At each raster time point (t1) the printing requirement is ascertained for a predetermined number of yet to follow raster time points (t2, t3) and for raster time points (t2, t1) without printing requirements and lying in advance of a raster time point (t3) with a printing requirement the current impulses (I1, I2) are progressively increased. Through the use of this method a thermal printer with a high printing speed is achieved.

11 Claims, 5 Drawing Sheets

HEATING ELEMENT ENERGIZATION METHOD FOR A THERMAL PRINTER

FIELD OF THE INVENTION

The invention concerns a method for controlling the energization of a thermal printing heating element with a succession of current impulses, separated in accordance with a printing raster, which upon exceeding a pre-given energy content effect a printing event and in the case of falling below this energy content effect a preheating.

BACKGROUND OF THE INVENTION

Such a method is used for example in a thermal transfer printer whose print head has printing elements arranged next to one another in a row. Between the print head and a graphics carrier to be printed upon is arranged a heat sensitive color tape which upon pointwise heating by a heating element above a printing temperature transfers a color point to the graphics carrier. A relative movement is created between the print head and the graphics carrier perpendicularly to the line of the printing elements. In predetermined time intervals designated heating elements are then energized with current and a printing event is effected. The graphics carrier is thereby printed in a raster way with characters or a pattern.

In a method known from DE 38 33 746 A1 the heating element is preheated if no printing event is effected. Current impulses are delivered to the heating element whose energy content heats the heating element to a temperature below the printing temperature. The amplitude and duration of the impulses can be controlled in dependence on the prevailing surrounding temperature and the constructional formation of the printing head. It is thereby achieved that the preheating temperature is uniformly distributed over the entire printing head area.

In this known method the energy delivered to each heating element for preheating is adjusted independently of whether the involved heating element often or seldom effects printing events. Since a high printing frequency at the printing element establishes a higher temperature than does a low printing frequency the average preheating temperature distributed over the entire printing head must lie distinctly below the printing temperature, so that even at high printing demands of the heating elements trouble-free printing will be achieved. This has the result that to effect a printing event the current impulse delivered to the heating element must have a high energy content in order that the heating element is heated to its printing temperature. The creation of such current impulse is technically expensive since the current impulse generator necessary therefor must have a high peak load capability.

In addition, in the case of a large temperature difference between the preheating temperature and the printing temperature the times required for the heating process and for cooling are also long. These times influence in great measure the printing speed achievable with the printing method. Since in the known method a sufficiently high temperature difference is necessary between the preheating temperature distributed uniformly over the entire print head area and the printing temperature to create the desired printing quality, the achievable printing speed is limited to a low value.

SUMMARY OF THE INVENTION

The object of the invention is therefore to provide a method for controlling the energization of a thermal printing heating element by means of which a high printing speed can be obtained.

The object is solved for a method of the previously described kind in that at each raster time point a printing requirement is ascertained for a predetermined number of following raster time points and that for raster time points without a printing requirement, which lie before a raster time point with printing requirement the energy content of the current impulses is progressively increased.

The invention rests on the consideration that the printing speed is maximum and the energy necessary for effecting a printing process is minimum if the heating element is preheated as close as possible to its printing temperature. Then, in this operating condition only a small additional energy is necessary to effect the printing event. Moreover, the heating time as well as the cooling time for the heating element is then short. Since the heating element is put under different demands over time, according to the pattern to be printed, the preheating energy delivered to it in accordance with the invention is individually suited to the printing program. In addition, at each raster time point by way of a preview it is ascertained whether a printing shall occur at subsequent raster time points. In this preview the two subsequent raster time points can for example be taken into account. Thereby the expense of the method steps of the preview remain small. If there is no printing requirement for the forelying time points, the preheating can be remain limited to a minimum or can even be omitted. In this way the preheating energy for the preparation of a printing event is then only expended when a printing requirement actually lies ahead. This means that energy is conserved.

If it is determined in the preview that in the near future a printing event is to be effected by a heating element the heating element is supplied with current impulses at raster time points in which it does not print to prepare the heating element. The energy content of these current impulses are then at the raster time points preceding the raster time point with the printing requirement, progressively increased so that the temperature of the heating element at the raster time point at which the printing event is to be effected lies narrowly below the printing temperature. For effecting the printing event the current impulse must then only have a small energy content in order to increase the temperature of the heating element from the preheat temperature to the printing temperature. The time required for this is then minimal, so that the printing speed within the operating limits of the thermal print head is maximized. Since the current impulses have low energy content their electrical output is also small so that electronic expense for creating the current impulses remains insignificant and a cost effective hardware solution for the current impulse generator can be used.

The raising of the energy content of the current impulses during the preheating phase can take place continuously, for example, in that the entire amount of energy for achieving the desired preheating temperature is calculated and the amplitudes and/or the durations of the current impulses are suited to it.

The preferred embodiment of the invention is characterized in that the raising of the energy content takes place in stepwise fashion. By this measure it is possible that the method can be suited in a simple way to known digital methods for controlling the thermal printing head by which the energization of the heating elements takes place already in discrete, adjustable current amplitudes or impulse widths.

In a further development of the previously described embodiment the current impulses have a constant amplitude with their durations being progressively lengthened. The duration of each current impulse can therefore be composed of time intervals of similar size.

Through this measure it is possible to use a simple constant current source for energizing the heating elements. The duration or impulse width of the current impulses is varied to change their energy content. Through the use of similarly sized time intervals in the realization of the impulse creation the switching expense can further be reduced since the current impulses can be derived by way of a coupling with the already provided timing impulses of a central control.

Another embodiment is characterized in that in the case of a thermal printing head with several heating elements arranged next to one another, at each raster time point the printing requirements for a predetermined number of yet to follow raster time points are ascertained, and that the raising of the energy content of the current impulse of the involved heating element is lowered if a printing requirement for a neighboring heating element is ascertained.

In this embodiment use is made of the technical effect that a portion of the heat of a heating element is transferred to the neighboring heating element. If a neighboring heating element is likewise to effect a heating event within the involved time frame and therefore is heated to a higher temperature, the energy portion which is transferred from this heating element to the heating element in question does not have to be delivered during the preheating phase. The energy content of the current impulse can then be lowered by this portion. Thereby a still more efficient energy use is achieved.

According to a further preferred embodiment the time slot for the current impulse in the raster interval is different from the time slot for the current impulse for at least one other heating element. This measure is advantageously used if a thermal printing head with very many heating elements, for example, 256 or 512 heating elements, is used for the printing. For example, in the printing of postage value characters onto envelopes in a postage meter such thermal printing heads come into use since with one single forward movement a very broad row of text can be printed. Through the measure of the aforementioned embodiment it is achieved that the heating elements of the thermal printing head are divided into at least two domains. The heating elements of the first domain are then supplied with current impulses slightly time displaced from those of the second domain. Through this time displacement the electrical power delivered to the heating elements can be distributed over time and the peak loading of the current source providing the current impulses can be lowered. The printing speed therefore need not be reduced.

Exemplary embodiments of the invention are explained hereinafter in association with the drawings. The drawings are:

DESCRIPTION OF THE PREFERRED EMBODIMENTS

Figure 1:
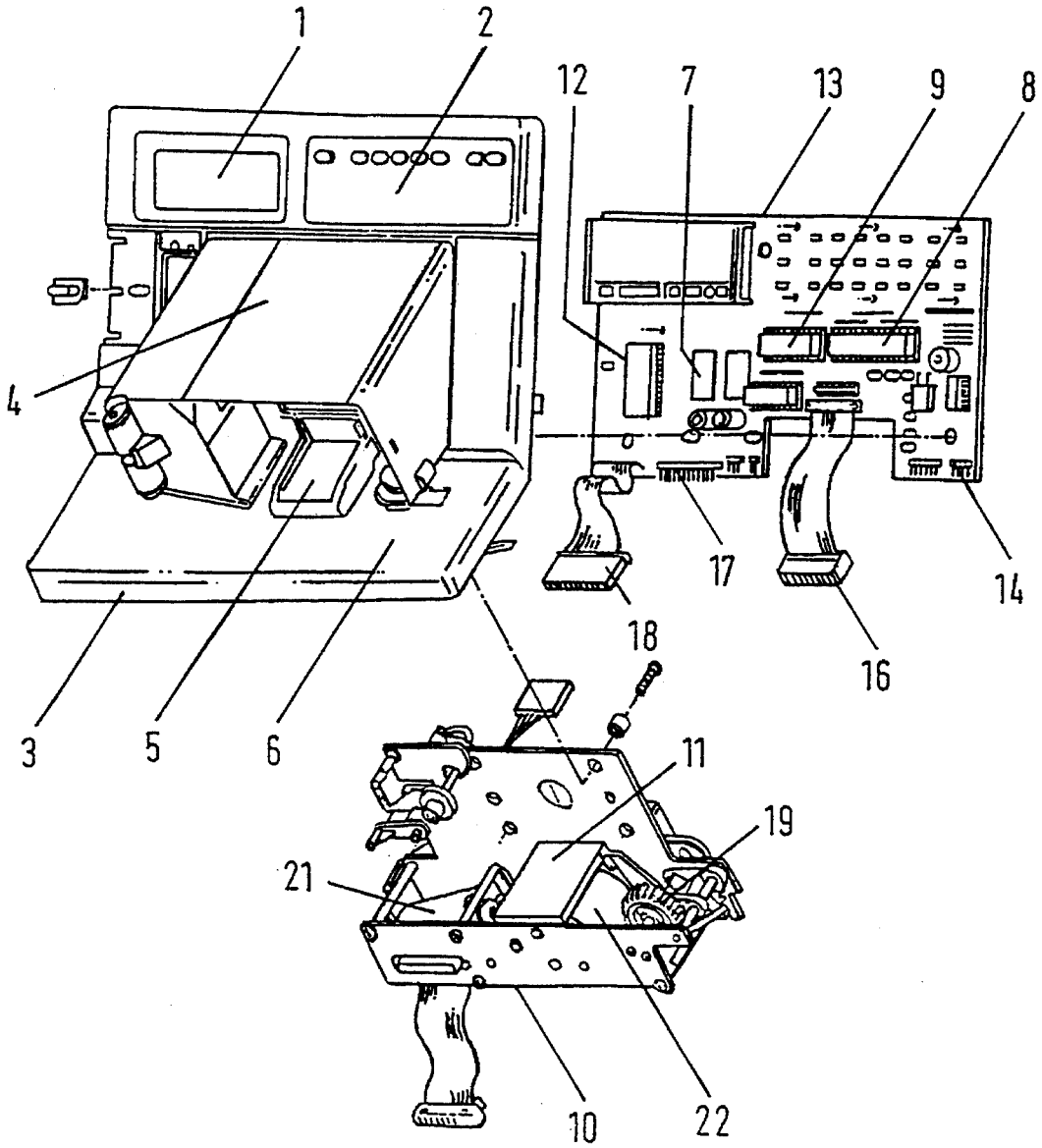
FIG. 1 An exploded perspective view of a postage meter with a thermal transfer printing mechanism.

The basic components of a postage meter, with which the invention is used, are illustrated schematically in FIG. 1. An indicator unit 1 and a keyboard 2 are arranged on the outside of a housing 3. An outwardly extending housing portion 4 receives a colored tape cassette (not shown) for the thermal transfer printer. The envelopes to be printed are moved between the underside of a print head carrier 5 and a support plate 6, with color particles from the color tape of the color tape cassette being transferred to the envelopes during the printing.

A control board 13 is illustrated at the right in FIG. 1 and contains a microprocessor 8, a work memory 7, a program memory 9, a serial interface 14, a printing head connector 16, a service interface 17, a customer specific read-only memory 12, and a power supply connector 18.

A printing mechanism 10 is illustrated schematically in the lower portion of FIG. 1 and is supported from the print head carrier 5. The printing mechanism 10 includes a thermal transfer print head 11 as well as a transport motor 21 for driving a transport roll 22 which advances the envelopes past the print head 11.

Figure 2:
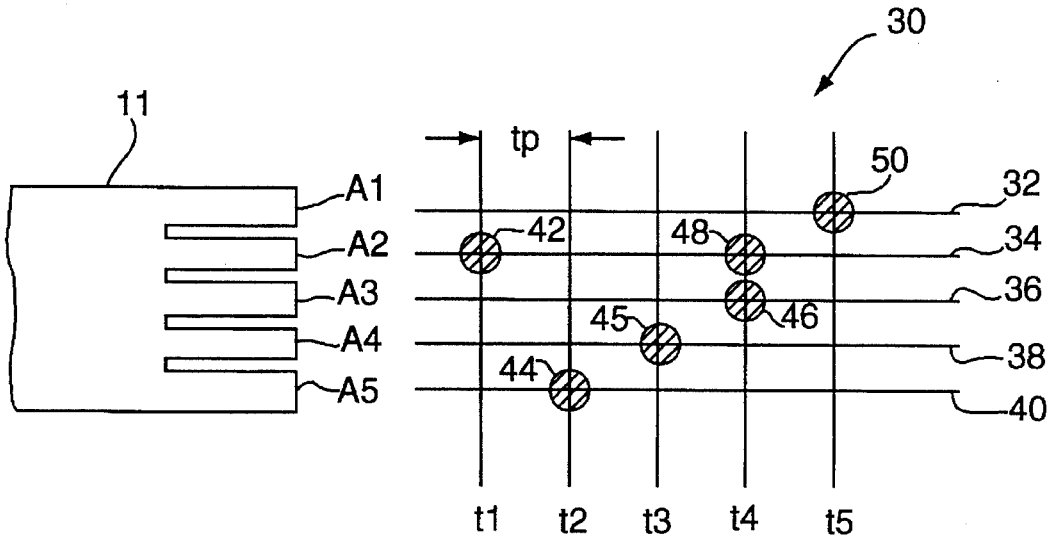
FIG. 2 A schematic illustration of a printing head with five heating elements.

The print head 11 is schematically illustrated in FIG. 2. On its side facing the color tape it has heating elements R1 to R5 which are arranged in a row next to one another and formed by electric resistances. For the printing a relative motion of nearly constant speed is created between a graphics carrier 30, for example, an envelope, and the print head 11. The printing process, in which the color of the color tape is transferred to the graphics carrier 30, for example, at the points 42 to 50, is carried out at raster time points t1 to t5, with equal time spacings tp through the heating elements R1 to R5 along the paths 32 to 40.

FIG. 2 shows only schematically the printing principle used here. In reality the print head 11 consists of substantially more heating elements, for example of 256 or 512 heating elements, which are arranged at small spacings next to one another. With the help of such a print head in a single relative movement between the graphics carrier 30 and the print head 11 a section with a width of about 60 mm can be printed as is required for example in the automatic printing of postage onto envelopes.

The method of the invention for controlling the energization of a heating element is described below in more detail with reference to FIG. 3 in connection with the heating element R4 which according to FIG. 2 at the raster time point t3 is to cause a printing event. In this figure the temperature T versus time t is given in the upper portion of the figure. At the raster time point t1 the heating element R4 has a temperature corresponding essentially to the surrounding temperature Tu. In accordance with the illustrated embodiment of the invention three raster time points t1, t2 and t3 are thereupon examined as to whether a printing process is to be carried out. In this case it is determined that at the raster time point t3 such a printing is to be carried out.

Then at the raster time points t1 and t2 the heating element R4 is preheated in preparation for the printing process so that the energy content of the electrical resistance of the heating element R4 is progressively raised by the current impulses I1 and I2 delivered in the time periods tp.

Figure 3:
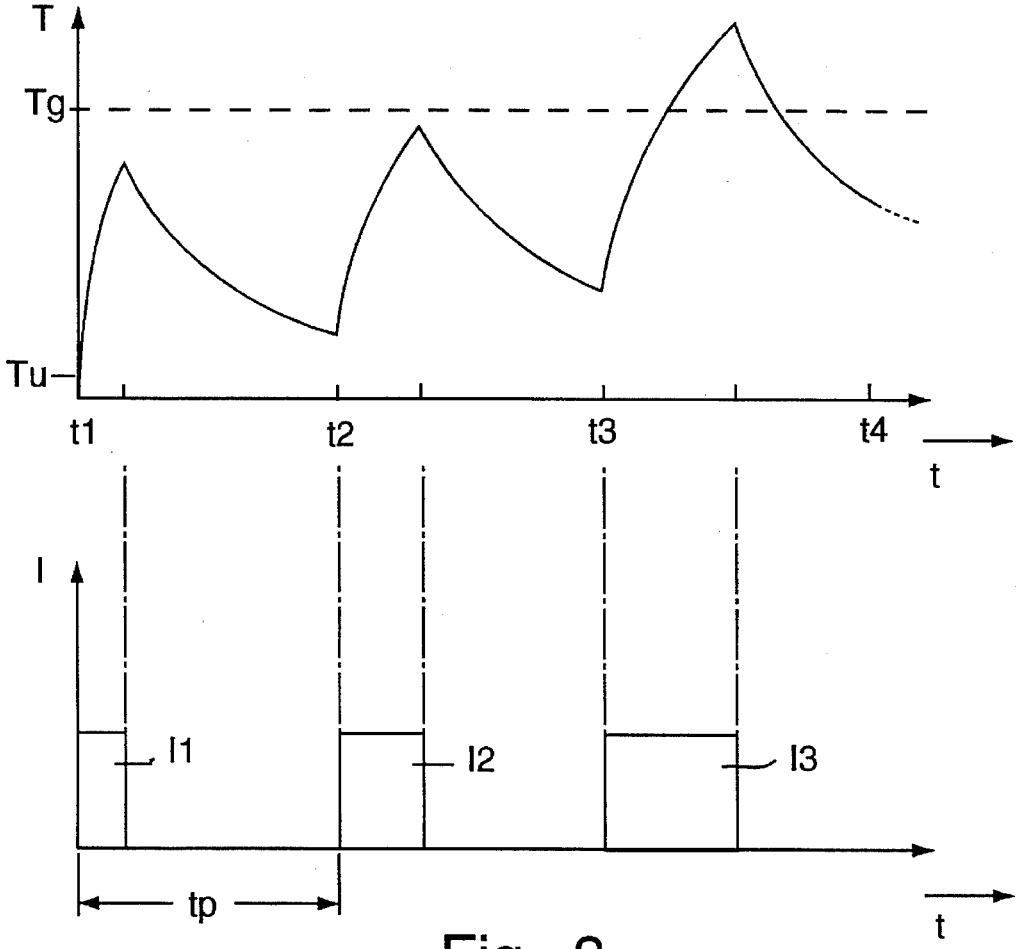
FIG. 3 A schematic illustration showing the course of the temperature of a heating element during the preheating phase and the printing phase with respect to time.

The current impulses I1 to I3 with respect to time t associated with the time points t1 to t3 are illustrated in the lower portion of FIG. 3. Their individual energy content is adjusted by the length of the impulse. The current impulse I1 delivered at the raster time point t1 causes a temperature rise at the heating element R4 to a point still clearly below the threshold temperature Tg above which a color transfer from the heat sensitive color tape to the graphics carrier 30 takes place, that is at which a printing event occurs. Because of heat dissipation to the surroundings the temperature again falls off to the raster time point t2 but nevertheless remains clearly above the surrounding temperature Tu.

At the raster time point t2 a current impulse I2 is delivered to the heating element R4 having a higher energy content than the current impulse I1, so that the temperature rises to the vicinity of the threshold temperature Tg. Therefore, when the printing process is to be carried out at the raster time point t3 the energy content of the associated current impulse I3 must only be slightly increased in order to exceed the threshold temperature Tg. Therefore, in accordance with the method of the invention, the heating element R4 is preheated until close to the threshold temperature Tg so that the actual current impulse I3 which causes the printing event can be minimized with respect to its energy content and therefore with respect to its duration. Therefore, a high repetition frequency for the printing events is possible and thereby a high printing speed is achieved.

Figure 4:
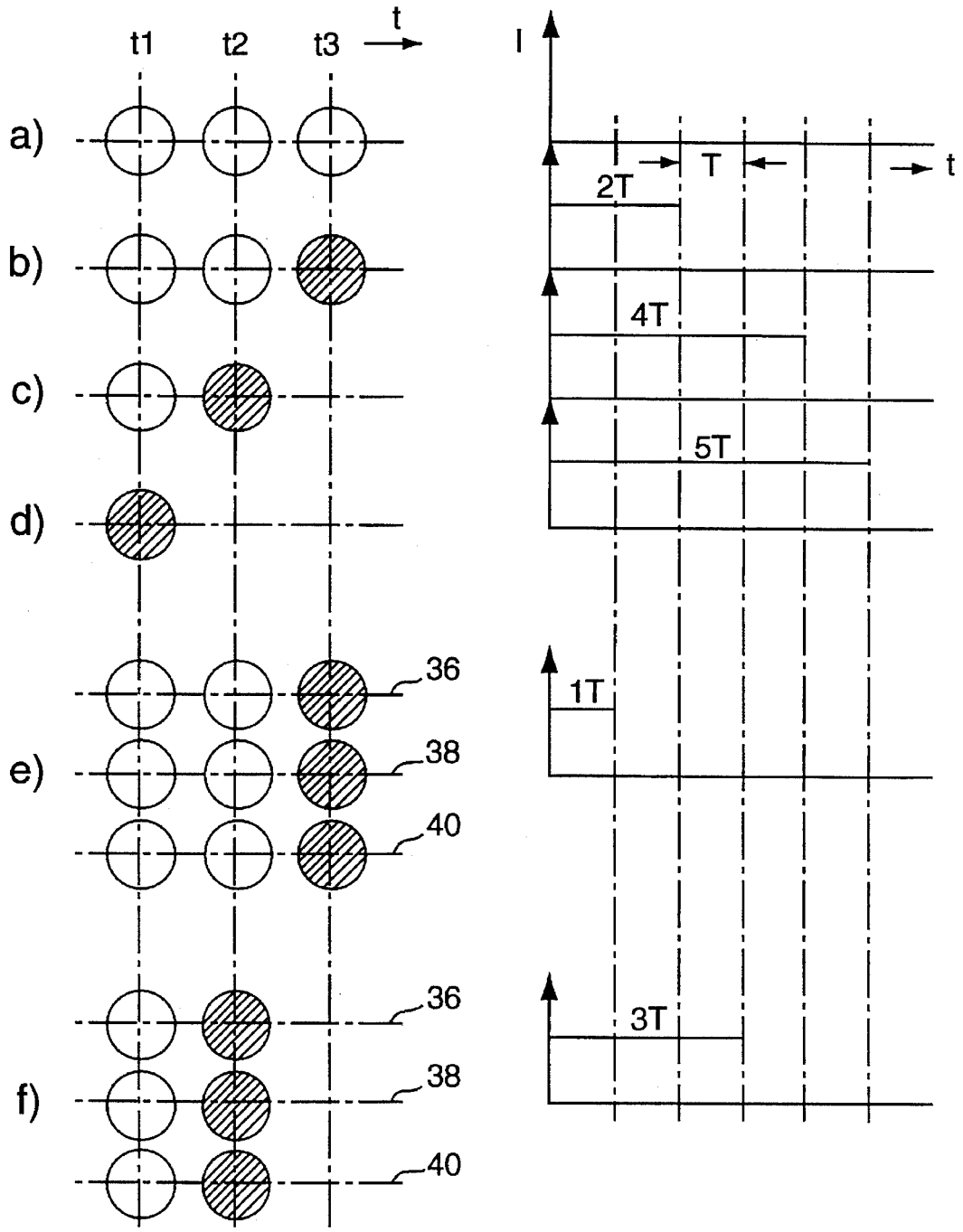
FIG. 4 A schematic illustration of the current impulses for different drive conditions of a heating element.

Different drive conditions a) to f) for the raster time points t1 to t3 and the associated current impulses which are delivered to the heating element R4 in each case at the raster time point t1 are illustrated in FIG. 4. In the left portion of the figure the circles indicate whether a printing event is to occur at the raster time points t1 to t3. An empty circle indicates that no printing event is to occur while a cross hatched circle indicates that a printing event is to occur. In drive condition a) no printing event is carried out at the raster time points t1 to t3. The heating element R4 has delivered to it no current impulse at the raster time point t1. A preheating does not take place.

In drive condition b) a printing event is to occur at the raster time point t3. To sufficiently preheat the heating element R4 a current impulse of constant amplitude is delivered to the heating element R4. The energy content of this current impulse is adjusted by the width or duration of the impulse. Moreover, the current impulse is composed of partial impulses each of which has the length of a time interval T. In the case of the drive condition b) in accordance with this a current impulse having an interval of 2T and composed of two partial impulses is created and delivered to the heating element R4.

In drive condition c) a printing event is required at the raster time point t2. To preheat to a temperature narrowly below the limit temperature Tg a high energy content of the current impulse is necessary, which is realized by lengthening the impulse duration to four time intervals T.

In drive condition d) a printing event is to occur already at the raster time point t1. In order to exceed the necessary limit temperature Tg a current impulse of duration of 5T is delivered to the heating element R4. When at the raster time point t2 following this a printing event is to be carried out again (not illustrated in the figure), the heating element R4 is again excited with a current impulse of duration 5T. The drive condition of the heating element by which it progressively carries out the printing events, for example, in order to create a continuous line on the graphic carrier determines the maximum achievable printing speed of the printing head 11. Since the durations of the current impulses for effecting the printing events is minimized by the method according to the invention, a high printing speed is obtained.

To determine the energy content of the current impulses in this example only three raster time points t1 to t3 are taken into consideration and the current impulse for creating a printing event is fixed at 5 time intervals T. Experience has shown that with this a considerable improvement is already achieved in respect to the printing speed, without the computing expense for ascertaining the required printing events and without the hardware expense for the individual preheating of the heating elements R4 being large. It is easy to comprehend that by the inclusion of further raster time points in the anticipatory preview as well as by a finer breaking-up of the impulse duration by a larger number of partial impulses a still better use of the potential for increasing the printing speed within the drive limit of a printing head is possible.

In drive condition e) for the determination of the energy content of the current impulse delivered to the heating element R4 also taken in to consideration are the drive conditions of the neighboring heating elements R3 and R5 arranged along the paths 36 and 40 (compare FIG. 2). At the raster time point t3 the heating elements R3, R4 and R5 are each to effect a printing event. Since all three heating elements R3, R4 and R5 are to be preheated and take on a higher preheat temperature with respect to the surrounding temperature Tu, less energy flows from the heating element R4 to the surroundings as it does without preheating of the neighboring heating elements R3 and R5. Because of this behavior the energy content of the current impulse delivered to the heating element R4 can be reduced. Therefore, at the raster time point t1 instead of the heating element R4 having delivered to it a current impulse of duration 2T (compare drive condition b)) a current impulse with reduced duration 1T is delivered. The same thing happens if only one of the heating elements R3 or R4 is to effect a printing event at the raster time point t3.

In drive condition f) a printing requirement occurs at raster time point t2. For this drive condition the duration of the current impulse delivered to the heating element R4 at the raster time point t1 is fixed at 3T. Things are done in the same way if only one of the heating elements R3 or R4 are to effect a printing event at the raster time point t2.

Figure 5:
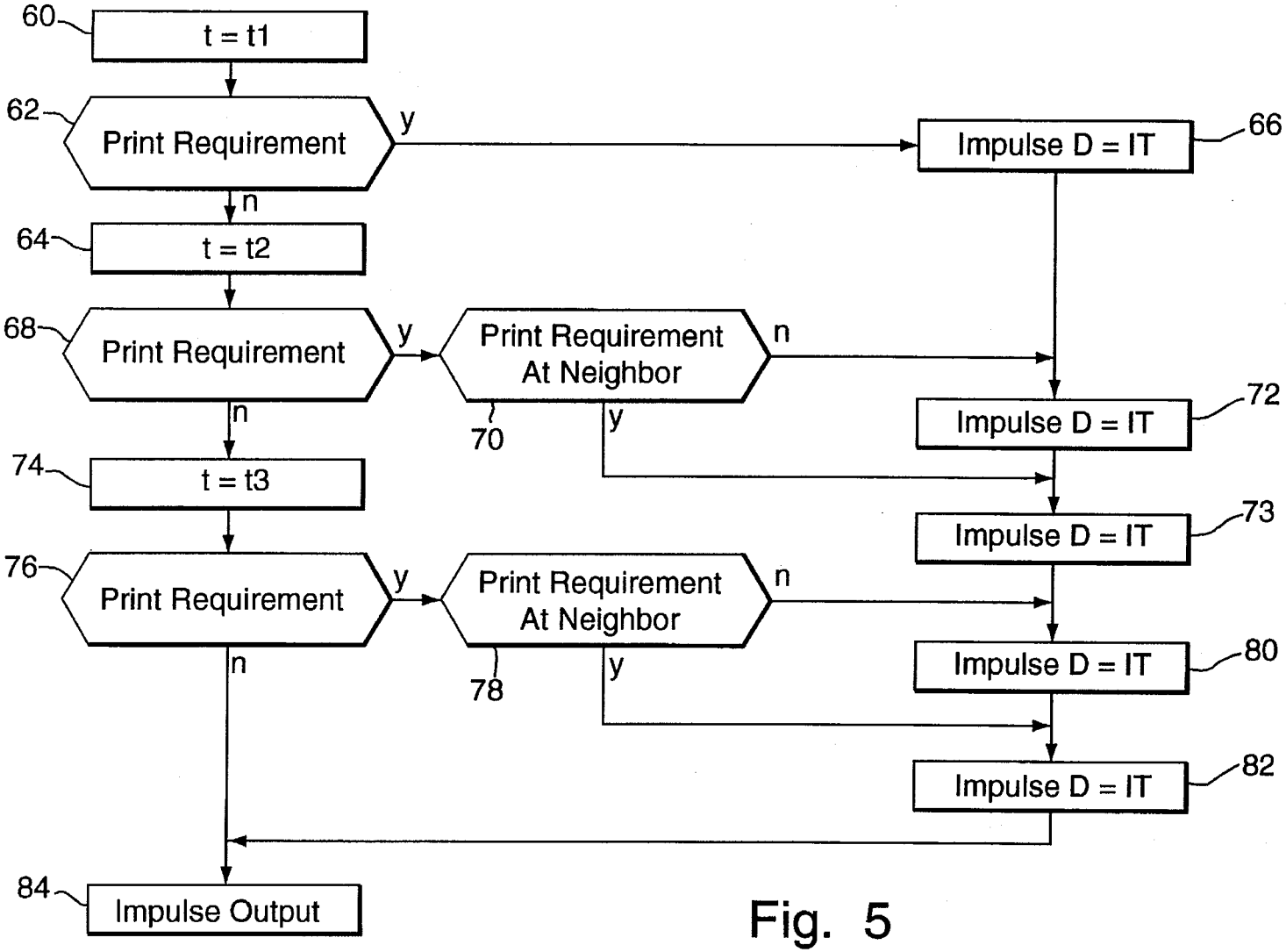
FIG. 5 A flow diagram for the creation of a current impulse for a heating element at a pre-given raster time point.

The course of a procedure for controlling the energization of the heating element R4 is illustrated schematically in FIG. 5 by a flow diagram. Such a procedure can for example be realized through the carrying out of a program with the help of the microprocessor 8 (compare FIG. 1). In the following more narrowly described procedural steps the drive conditions shown in FIG. 4 are recognized and the current impulses belonging to them are output.

In method step 60 it is determined from the print data transmitted to the print head 11 whether a printing requirement is to occur for the heating element R4 at the actual raster time point t1. If this is the case, in method step 62 a branching takes place to method step 66. In this step a partial impulse of duration 1T, that is a time interval T, is created. In the other case an advancement is made to the method step 64. In this an analysis is made of whether a printing requirement for the heating element R4 is needed at the raster time point t2. In the event of a yes answer in the method step 68 a branching is made to the step 70 and it is determined whether one of the neighboring heating elements R3 or R5 or both are to effect a printing event. If this is true in method step 72 a further partial impulse of duration 1T is created. In the other case the method step 72 is omitted. In the following method step 73 a partial impulse is again created.

Next, in the method step 74 a determination is made of whether a printing requirement is needed for the heating element R4 at the raster time point t3. In the case of a positive result in the method step 76 a branching is made to the step 78. In this step an investigation is made of whether at the raster time point t3 a printing event is to be effected by the neighboring heating element R3 or R5 or both simultaneously. If this is the case, in method step 80 a further partial impulse of duration 1T is generated.

In the event in method step 76 no printing requirement is determined a branching is made to method step 84 and the current impulse made up of the partial impulses created in the steps 66, 72, 73, 80 and 82 is output. This current impulse can have a duration of from 5T to 0T (blank impulse).

Figure 6:
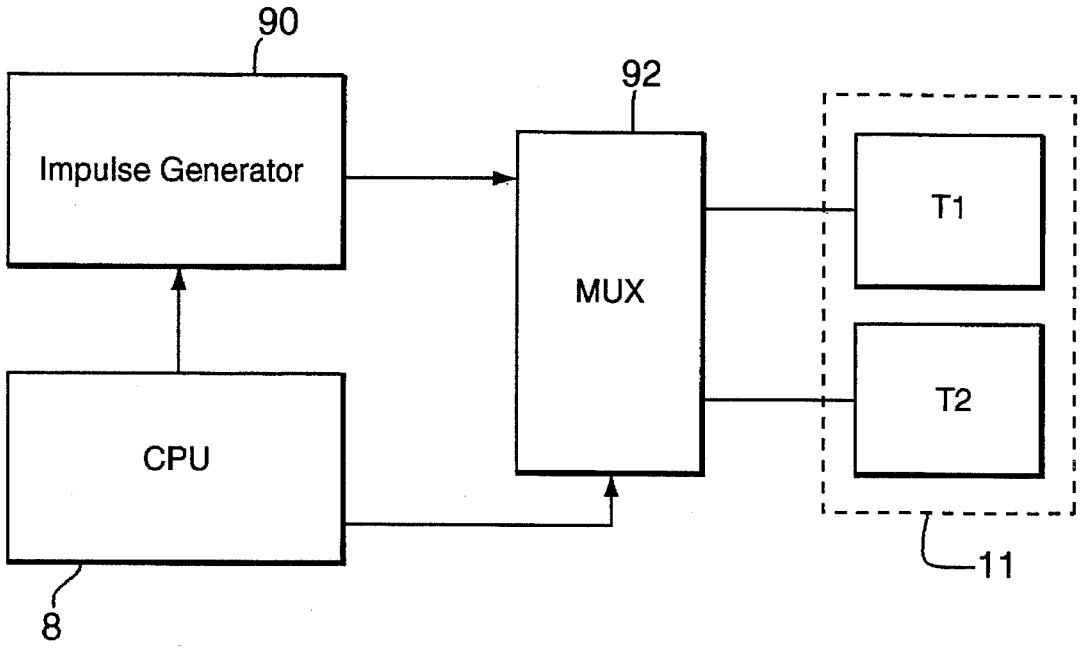
FIG. 6 A block circuit diagram of a control for the time displaced energization of two heating elements according to the multiplex method.

In FIG. 6 the control for the energization of heating elements according to the time slot method is schematically illustrated in a block circuit diagram. The heating elements of the print head 14 are hereby divided into two domains T1 and T2. Through a multiplexer 92 they are supplied with current impulses in timewise displaced fashion. The switch position of the multiplexer 92 is controlled by the microprocessor 8. An impulse generator 90 in dependence on data from the microprocessor 8 creates current impulses which are delivered to the multiplexer 92. Through the use of the time slot method it is possible to feed a large number of heating elements of a printing head 11, for example 512 heating elements, with one simply constructed electrical current impulse generator 90 since its peak current loading is reduced by the time displacement.

Figure 7:
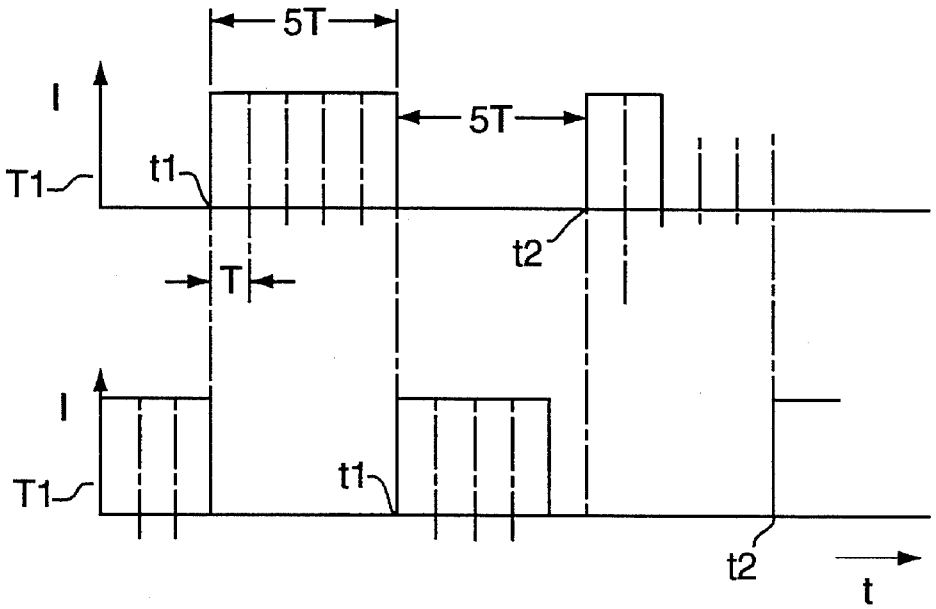
FIG. 7 A schematic diagram showing the current impulses delivered to the heating elements over time in accordance with FIG. 6.

In FIG. 7 the variation of the current with respect to time t for one heating element from each of the domains T1 and T2 is illustrated. As is to be seen from the figure, in each case the corresponding raster time points t1 and t2 are displaced from one another by 5 time intervals T, that is for the duration of a current impulse for effecting a printing event. Therefore, there results for each domain T1, T2 an impulse-pause relationship or pulse duty factor of 50%. Since the impulse duration of a current impulse for effecting a printing event in the method according to the invention is minimal, through the application of the time slot method full use can be made of the advantage of high printing speed.

I claim:

1. A method for controlling the energization of a thermal printer heating element at a succession of raster time points of a printing raster by means of a succession of current impulses each associated with a respective one of said raster time points, said heating element upon being energized by one of said current impulses which exceeds a pre-given energy content producing a printing event at the associated raster time point and upon being energized by one of said current impulses which falls below said pre-given energy content being pre-heated without producing a printing event at the associated raster time point, and in which method the energy content of the current impulse associated with one of said raster time points is dependent on whether or not a printing event is required at the next following one of said raster time points, said method comprising:

for each one of said raster time points ascertaining the printing event requirements for that one raster time point and for a predetermined number of successively following raster time points, inspecting the results of said ascertaining step to determine whether of the raster time points considered in said ascertaining step any raster time points without printing event requirements are followed immediately by a raster time point with a printing event requirement, and if from said inspecting step a set of successive raster time points is found made up of raster time points without printing event requirements and an immediately following raster time point with a printing event requirement progressively increasing the energy content of the current impulses associated with the raster time points of said set.

2. The method according to claim 1, further characterized by in said step of progressively increasing the energy content of said current impulses progressively increasing said energy content in a stepwise manner.

3. The method according to claim 1, further characterized by in said step of progressively increasing the energy content of said current impulses keeping said current impulses of a constant amplitude and progressively lengthening their durations.

4. The method according to claim 3, further characterized by making up the duration of each of said current impulses using time intervals of similar size.

5. The method according to claim 4, further characterized by making the duration of each of said current impulses which is to produce a printing event at the associated raster time point consist of five of said time intervals.

6. The method according to claim 1, further characterized by in said ascertaining step ascertaining for each one of said raster time points the printing event requirement for said one raster time point and for each of the two raster time points immediately following said one raster time point, and in the case of there being no printing event requirement for any of said one raster time point and said two immediately following raster time points producing no current impulse associated with said one raster time point.

7. The method according to claim 1, further characterized by formulating said succession of current impulses so as to have a constant period.

8. The method according to claim 7, further characterized by making up the duration of each of said current impulses using time intervals of similar size, said time intervals being a whole number of times smaller than said constant period of said succession of current impulses.

9. The method according to claim 1, further characterized by providing said thermal printer heating element as one element of a thermal printing head having several thermal printer heating elements arranged next to one another so that said one thermal heating element has at least one neighboring thermal heating element positioned next to it, and in said step of progressively increasing the energy content of the current impulses associated with the raster time points of said set reducing the energy content of said current impulses if a printing event requirement is determined for said at least one neighboring heating element.

10. The method according to claim 9, further characterized by producing current impulses for energizing at least one of said several heating elements of said thermal printing head during one set of successive time slots and by producing current impulses for energizing at least one other of said thermal heating elements of said thermal printing head during a second set of successive time slots with the time slots of said second set being different from the time slots of said first set.

11. The method according to claim 10, further characterized by said raster time points being separated from one another by a raster period, and the time slots of said first set of time slots being displaced from the time slots of said second set of time slots by half of said raster period.

* * * * *